United States Patent [19]

Weltman et al.

[11] 4,177,555

[45] Dec. 11, 1979

[54] WIRE-WRAPPING TOOL FOR NON-STRIPPED WIRE

[75] Inventors: David Weltman, Pleasantville; Thomas Rivera, New York, both of N.Y.

[73] Assignee: O.K. Machine and Tool Corp., New York, N.Y.

[21] Appl. No.: 921,436

[22] Filed: Jul. 3, 1978

[51] Int. Cl.[2] ..... B21F 15/04; H01R 11/08

[52] U.S. Cl. ..... 29/751; 140/124; 242/717

[58] Field of Search ..... 7/107; 29/751; 140/119, 140/122, 124; 242/7.06, 7.17

[56] References Cited

U.S. PATENT DOCUMENTS

| | | | |
|---|---|---|---|
| 2,682,063 | 6/1954 | Miloche | 242/7.06 X |
| 2,688,449 | 9/1954 | Haagensen | 140/124 |
| 2,759,166 | 8/1956 | Mallina | 29/605 X |
| 3,213,894 | 10/1965 | Etchison et al. | 242/7.17 X |
| 3,229,729 | 1/1966 | Robey et al. | 242/7.17 |
| 3,893,491 | 7/1975 | Jackson et al. | 140/122 |
| 3,967,661 | 7/1976 | Scoville et al. | 140/124 |
| 4,076,056 | 2/1978 | Dummel | 140/124 X |

FOREIGN PATENT DOCUMENTS

| | | | |
|---|---|---|---|
| 528714 | 12/1976 | U.S.S.R. | 140/124 |

*Primary Examiner*—Ervin M. Combs

[57] ABSTRACT

A tool for wrapping insulated wire without first stripping or slitting the insulation is obtained by means of a novel bit configuration which crushes the insulation during the wrapping process causing the terminal corners to pierce and contact the wire core. Additional features include means for breaking the wire after wrapping, and means providing a continuous supply of fresh wire.

11 Claims, 5 Drawing Figures

WIRE-WRAPPING TOOL FOR NON-STRIPPED WIRE

This invention relates to a wire-wrapping tool and wrapping bit therefor for wrapping insulated electrical wire around a terminal, and to a method for wrapping wires.

Traditional wire wrapping tools for insulated electrical wire intended for making wired connections to terminals of electronic and telephonic equipment normally require that the wire end first be stripped of its insulation before wrapping about the terminal. An improved tool which eliminates the need for prestripping of the insulation is described in U.S. Pat. No. 2,836,837. This tool includes slitting means in the bit face adjacent the wire exit hole for slitting the insulation longitudinally just before the wire contacts the terminal, baring the wire core which can then be caused to contact the terminal.

The present invention has as its main objective provision of a novel wrapping bit and method of using same enabling wrapping of a wire around a terminal or the like to make electrical connection thereto but without pre-stripping or pre-slitting the wire.

A further object of the invention is a novel wrapping tool providing a continuous supply of fresh wire, especially useful for making daisy-chain connections.

Still another object of the invention is a novel wrapping tool providing for automatic severing of the wire upon completion of the wrapping.

An additional object of the invention is a novel wrapping tool of simple construction and capable of low cost manufacture.

These and further objects and advantages of the invention as will appear hereinafter are achieved, briefly speaking, with a wrapping tool having a novel bit face construction which provides a tightly wrapped wire connection that results in crushing and piercing of the insulation where it contacts the terminal corners thereby exposing the wire core and enabling a sound mechanical and electrical connection between the wire and the terminal. Further features of the invention provide for means on the tool to furnish a continuous supply of wire to the bit face, and additional means on the tool to lock the wire to the tool such that continued rotation of the bit severs the wire at the bit face and wraps down the free end of the wire on the terminal.

One exemplary embodiment of the invention will now be described in greater detail with reference to the accompanying drawings, wherein.

Figure 1:
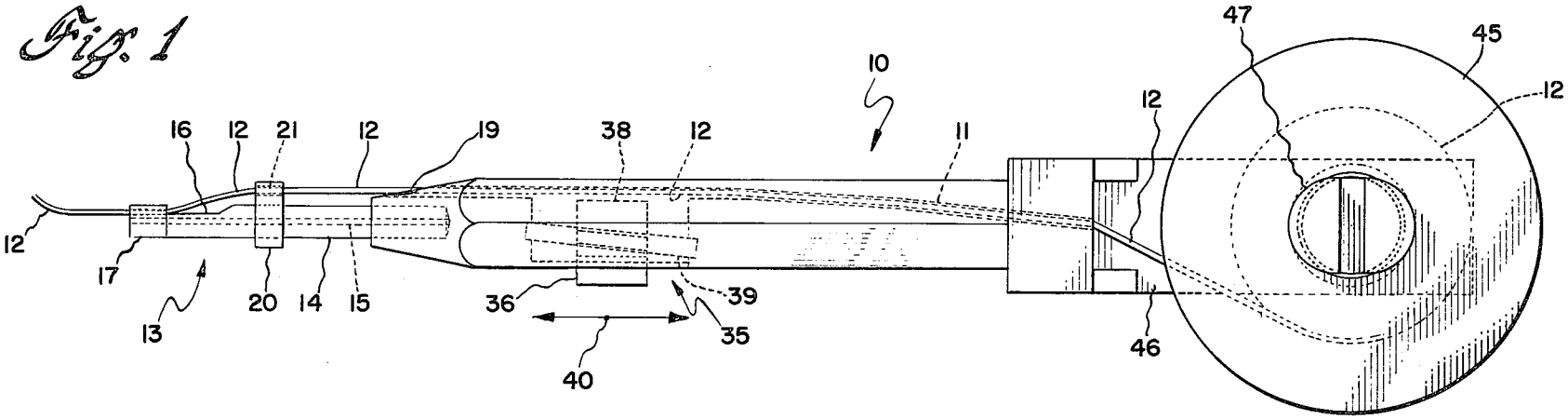
FIGS. 1 and 2 are side and plan views, respectively, of one form of tool in accordance with the invention.
Figure 5:
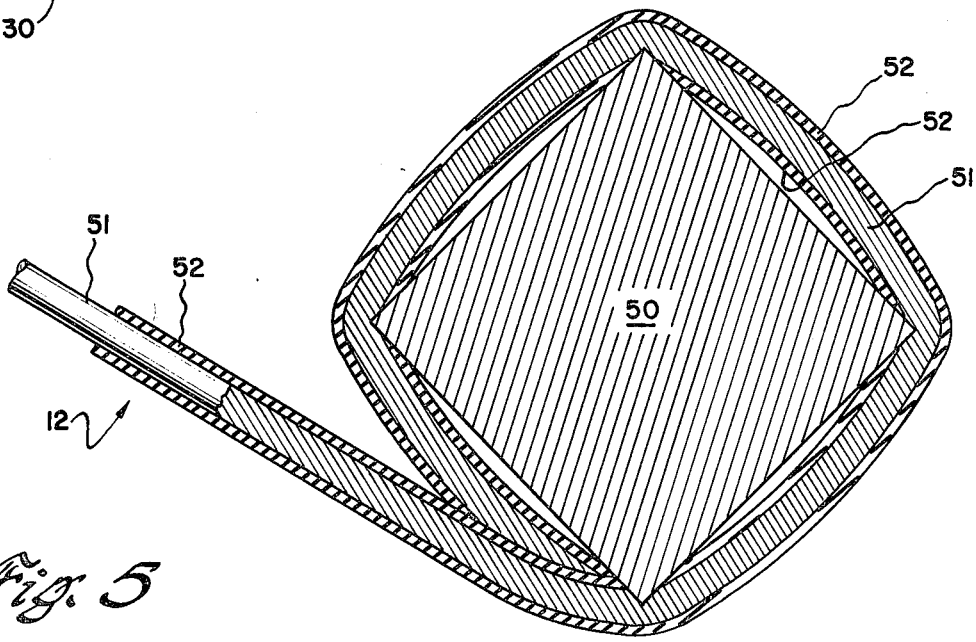

FIG. 5 schematically illustrates a wire coil formed by the tool of FIG. 1 on a terminal.

Figure 2:
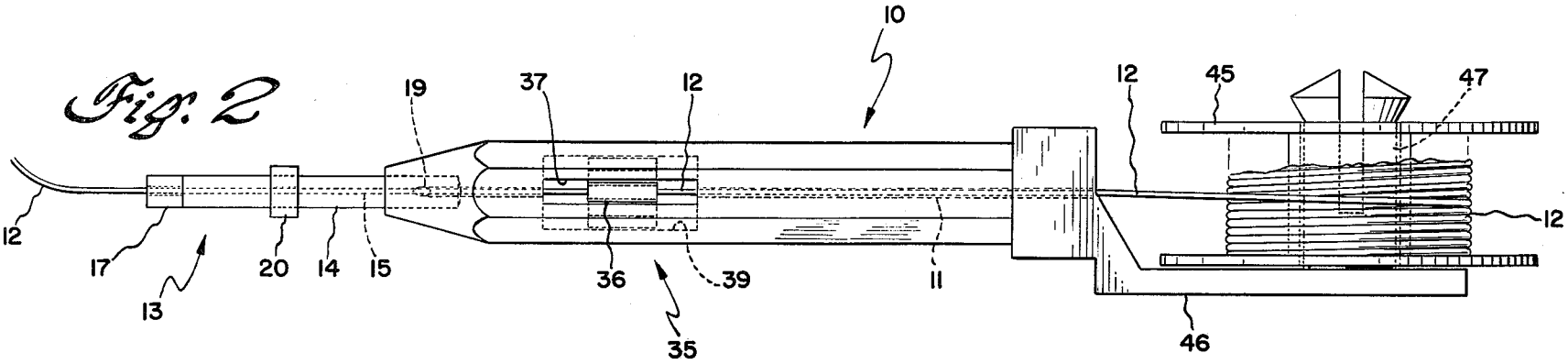
Figure 3:
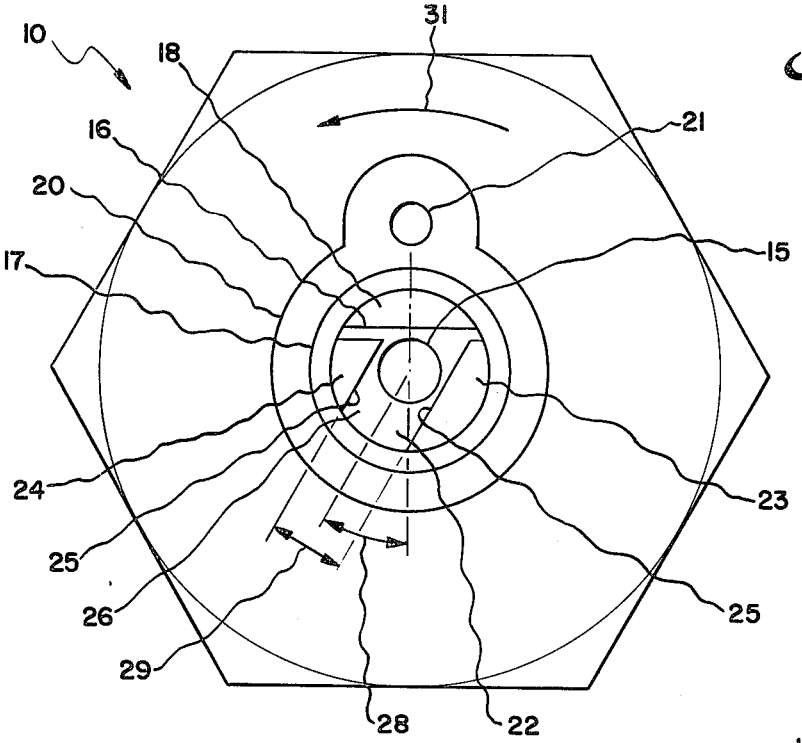
FIG. 3 is an end view of the tool of FIG. 1 but without the wire in position.
Figure 4:
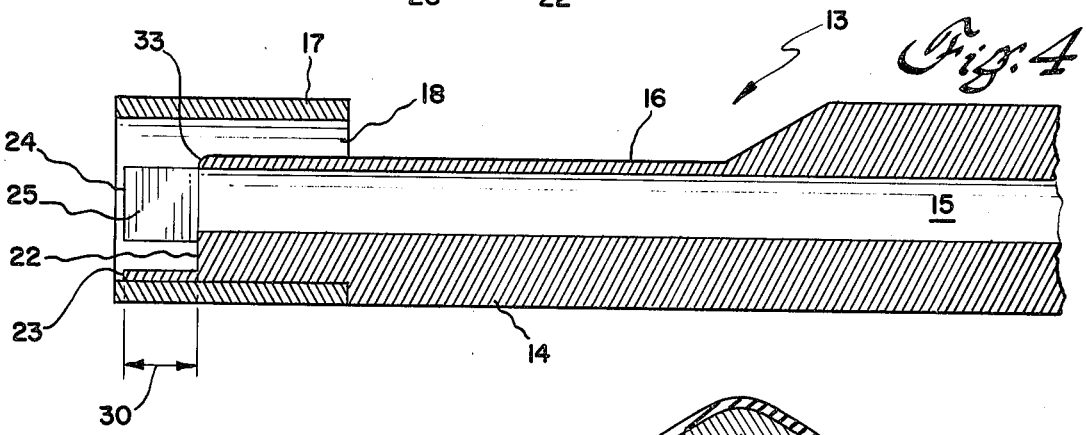
FIG. 4 is an enlarged cross-sectional view of the wrapping bit of the tool of FIG. 1.

FIGS. 1 and 2 are side and plan views, respectively, of one form of tool in accordance with the invention. The tool comprises a handle portion 10 containing a hollow region or longitudinal passageway 11 through its interior for passage of an insulated wire 12 for wrapping about a terminal. Projecting forwardly from the handle end is a wrapping bit 13, which comprises a shaft 14 having a center bore or hole 15 for receiving the terminal. The shaft end has a clearance flat 16, on the end of which is fixed a short sleeve 17, defining with the flat 16 an exit opening 18 (see FIG. 3) for the wire 12. As shown in FIG. 1, the wire 12 exits from the housing 10 at point of exit 19, passes along the top of the bit 14 guided by wire guide 20 in the form of a plastic sleeve mounted on the bit shaft 14 and having an opening 21 for guiding the wire 12. The wire is guided over the flat 16 through the wire exit opening 18 in the bit face. FIG. 4 shows an enlarged cross-sectional view of the bit and FIG. 3 an enlarged end view of the bit face without the wire present.

Projecting forwardly from the surface 22 where the terminal-receiving hole 15 and wire-exit hole 18 terminate are spaced lands 23, 24 having opposed parallel walls 25 adjoining opposite sides of the terminal hole 15 and defining a channel 26. As illustrated in FIG. 4, the sleeve 17 is mounted, as by gluing or the like, on a recessed portion of the shaft end, and projects slightly forwardly of the projecting lands 23 and 24. The channel axis, also as shown in FIG. 3, is tilted at an angle designated by numeral 28 of about 30° relative to a vertical line passing through the longitudinal axes of the terminal-receiving and wire-exiting holes 15 and 18.

The configuration of the bit face is critical to achieve the objective of the invention. The requirements to be satisfied include:

(a) avoid fracturing the wire, or severely nicking or denting the wire which could lead to fracturing during wrapping, or unwrapping of the wire, if desired, (b) maintain the integrity of the insulation except adjacent the terminal corners where contact is made, (c) make a firm mechanical connection to the terminal, which requires that the terminal corners bite into the wire core and vice-versa, (d) ensure piercing of the insulation where it contacts the terminal corners so that the exposed wire core makes a good electrical contact with the metal terminal.

The bit features which enable the above requirements to be satisfied include:

(1) provision of a channel 26 defined by forwardly projecting substantially parallel walls 25 located on opposite sides of a centered terminal hole 15. The channel width, indicated by numeral 29, preferably is approximately equal to the sum of the terminal corner-to-corner dimension (the terminal has a rectangular or square cross-section), the wire core diameter, and the wire insulation wall thickness;

(2) tilting of the channel, indicated by 28, with respect to a line perpendicular to the terminal and wire hole axes (which line is vertical in FIG. 3) at an angle preferably between approximately 20°–35° in the direction opposite to tool rotation during use;

(3) a channel depth, indicated in FIG. 4 by numeral 30, that preferably exceeds a value of twice the wire diameter.

The channel width dimension, indicated at 29, is significant because the wire insulation is pierced by the terminal corners as a result of crushing or squeezing of the wire beteen the terminal corners and the adjacent opposed channel walls 25. This will be clearer from the following example of a bit configuration successfully employed for wrapping 30 gauge wire. 30 gauge wire has an overall diameter of 20 mil (1 mil=0.001 inches), of which the metal core is 10 mil and the insulation wall thickness 5 mil. The typical terminal for a 30 gauge wire has a corner-to-corner spacing of 35 mil. The bit had a center hole 15 for the terminal of 36 mil diameter, centered between channel walls 25 spaced apart 50 mil. The center line of the channel formed an angle of 30°, designated 28 with the vertical. The tool rotation during use is indicated by the arrow 31. The channel depth 30 was 50 mil. The channel walls 25 terminated 10 mil short of the flat 16 of the bit, but could be extended if desired to the flat 16.

Thus, the overall diameter of a wire turn on the terminal for the dimensions indicated amounts to 75 mil (35+20+20), which is now being squeezed into a 50 mil wide channel. This squeezing of the wire turns during the wrapping process results in piercing of the insulation where it contacts the corners, forcing the terminal corners to penetrate the crushed insulation and to contact the wire core forming a good mechanical connection due to biting of the wire into the terminal corners and biting of the corners into the wire, but without excessive nicking of the wire to the extent that it becomes severely weakened or actually fractures.

The channel depth, the dimension indicated at 30, contributes to the foregoing result because as the wire begins to coil around the terminal, the first turn forms a long helix, but the second turn pushes the helix toward the channel bottom 22 and shortens it into the usual closely wrapped configuration. Thus the coil slides down along the terminal corners into the channel during the wrapping process, and this sliding action contributes to piercing of the insulation where it contacts the terminal corners. Thus, we prefer a channel depth that is at least 2 times the wire diameter; for 30 gauge wire, this is at least 40 mil.

As will be noted by those skilled in the art, due to the novel bit face configuration, the wire will be coiled tighter around the terminal than with prior art wrapping bits in order to ensure piercing of the insulation by the terminal corners, which means that as the wire exits from the wire hole 8, it is pulled with greater pressure over the corner, designated 33 in FIG. 4, at the top of the bit face. This can cause breaking of the wire. Breaking that corner with a radius as shown, known in the prior art, which is also done with our tool, will not by itself avoid breaking of the wire. In addition, the angle at which the wire contacts the channel wall surfaces 25 must be reduced from the usual 90° to a lesser angle. This is the reason for tilting of the channel relative to the vertical in FIG. 3 by the angle designated 28. We have found that best results are obtained when the angle 28 lies in the range between approximately 20°–35°. The fixed sleeve 17 in front which surrounds the bit face confines the coiling of the wire and prevents overwrapping.

The tool of the invention as above described has successfully made wire-wrapped connections with 30 gauge wire having different kinds of insulation, including "kynar", "mylene", "teflon" and "tefzel" insulation which are well-known trademarked plastic insulators. It has been found that by the time the second coil has been wrapped around the terminal, a good, reliable electrical connection has been made to the terminal. However, it is preferred that the wrapping be continued until at least four complete turns have been formed.

As the wire is drawn out of the wire hole 18 during the wrapping process, it is forced between the two camming surfaces 25, providing the pressure needed to achieve the tightly wrapped coils desired. If the wire motion is arrested while the tool rotation is continued, the wire will fracture or break at a point past radius 33 due to the tight wrap. This effect is utilized in accordance with a further feature of the invention for severing the wire whenever desired. In accordance with this feature of the invention, means are included in the tool to lock the wire to the tool and prevent it from further movement. When the tool is further rotated, the wire will automatically break and the last turn wiped down over the terminal by the channel walls.

One form of wire lock or stop in accordance with the invention is depicted at 35 in FIGS. 1 and 2. It comprises a slide member 36 mounted in a slot 37 in the handle 10 and having a locking surface 38 located adjacent the passageway 11 through which the wire is pulled during wrapping. The slide member 36 is mounted in a channel 39 formed in the tool housing for longitudinal motion indicated by the arrow 40. The slide 36 is actuable by the thumb of the user from an open or wrap position when the slide is at the right-most position of its slot 37, to a lock or cut position when it is moved to the left in FIG. 2 to its left-most position. The channel 39 in which the slide moves is tilted inward as shown toward the wire passageway 11. In its open position, the slide facing surface 38 is spaced from the wire 12. When moved to its lock position, where it is held by friction, the slide surface 38 jams the wire 12 against its passageway or housing wall locking the wire to the housing 10. By releasing the slide, the wire is again free to move through the passageway 11.

The wire is conveniently supplied from a spool 45 removably mounted on the tool end remote from the bit face. As illustrated in FIGS. 1 and 2, a generally L-shaped bracket 46 is secured, as by molding or gluing, to the housing 10, and the distal end of the bracket 46 is provided with a split hub 47, which acts as a removable spool retainer. The split end, which is resilient, is slightly curved outwardly. The spool 45 mounts on the hub 47 as shown, and the spread split end retains the spool on the bracket 46. By pressing the split ends together, the spool is readily removed and replaced with a new spool of wire when desired.

As will be evident from the foregoing description, the tool of the invention is characterized by simplicity and is thus capable of low-cost manufacture. With the exception of the bit itself, it is composed entirely of low cost plastic. It enables the simplest possible wire-wrapping process, since no special pre-treatments of the insulated wire, such as stripping or slitting of the insulation is necessary, nor are any post-wrapping heat treatments of the connection necessary. The method described is suitable both for solid conductors and stranded conductors, covered by any of the conventional insulator materials, and does not require plating, tinning or any other special preparation of the conductor core, nor special insulator compositions. The insulation remaining on the wire coils shields the connection from contamination and mechanical impact, and also serves to prevent accidental electrical shorts to adjacent terminal connections however closely spaced. The technique does not require precut wires to any specific length. It permits discontinuous connections to be made between only two terminals, or continuous connections between three or more terminals, commonly known as daisy chain connections. Economy of wire use is afforded since no scrap results, as only that amount of wire is used as is necessary to traverse the distance between the interconnected terminals. Electrically sound, reliable interconnections result. It is not only applicable to No. 30 gauge wire as described, but also to the other wire gauges conventionally used to interconnect electronic components, such as No. 24, 26 and 28 gauge wire. However, it will be understood that appropriate scaling of the bit face configuration in accordance with the teachings herein will be necessary for these larger size wires. The wrapped connection has its end wrapped down so no undesired pigtail results. The resultant wrapped connection can be readily unwrapped without breaking the wire using conventional unwrap tools and rewrapped if desired.

FIG. 5 schematically illustrates a wire coil formed by the tool and method of the invention. The terminal is depicted at 50, with one wire coil electrically connected to it. The wire 12 shown has a solid metal core 51 covered by insulation 52. As shown, the terminal corners pierce through the inner layer of insulation 52 to make electrical connection to the wire core 51.

While a hand tool has been described employing the principles of the invention, it will be evident to those skilled in the art that the tool can also be electrically, mechanically or pneumatically powered. For this purpose, a standard wrapping gun can readily be modified to include the wrapping bit of the invention substituted for a conventional wrapping bit and sleeve. The wrapping bit of the invention can be employed alone in a hand or power tool without the continuous wire supply afforded by the wire spool and without the lock for breaking the wire, in which event the wire would be manually fed through the wire guide 20 and the rear of the front sleeve 17 to the bit face in a manner similar to that illustrated in connection with the preferred embodiment disclosed. While the spool and wire lock constructions described are preferred, it will be obvious that other means for mounting the spool and for locking the wire to the tool can be substituted following the principles enunciated herein.

While our invention has been described in connection with specific embodiments thereof, those skilled in the art will recognize that various modifications are possible within the principles enunciated herein and thus the present invention is not to be limited to the specific embodiments disclosed.

We claim:

1. A wire-wrapping tool for wrapping a non-stripped and non-slitted insulated wire around a terminal, comprising n elongated housing, means at one end of the housing for providing a supply of insulated wire and comprising a removable spool of wire mounted at said one housing end, means at the opposite end of the tool for wrapping the insulated wire around a terminal, said wrapping means comprising a bit face having a terminal-receiving opening and a wire-exiting opening, means on the bit face upon rotation of the tool for wrapping the wire exiting through the wire-exiting opening so tightly that the wire insulation adjacent the terminal corners is pierced causing the bared wire core to form a good electrical connection to the terminal, said housing having a passageway through its interior for movement of the wire from the spool to the bit face, and wire-locking means comprising means on the housing for releasably jamming the wire up against a housing wall, said wire-locking means comprising a member slideably mounted on the housing and having a wire jamming surface adjacent the wire passageway, said slideable member being user slideable from a wire-release position wherein the wire-jamming surface does not jam the wire against a housing wall, to a wire-lock position wherein the wire-jamming surface does jam the wire against the housing wall, whereby after locking of the wire further rotation of the tool will cause the wire to sever at the terminal due to the tight wrap and the last turn to be wrapped down.

2. A novel wrapping bit configuration for wire-wrapping a non-stripped and non-slitted insulated wire around a terminal, comprising an elongated shaft having adjacent terminal-receiving and wire-supplying passageways terminating in adjacent holes at a bit face surface at a forward end of the shaft, and forwardly-projecting parallel wall portions on the bit face surrounding the terminal-receiving hole, said forwardly-projecting parallel wall portions forming a channel having a depth at least equal to twice the overall diameter of the insulated wire and with the parallel walls spaced apart by an amount approximately equal to the sum of the terminal corner-to-corner dimension, the wire core diameter, and the wire insulation wall thickness, said channel being tilted with respect to a line perpendicular to the terminal-receiving and wire-exiting holes at an angle of approximately 20°–35° in the direction opposite to bit rotation during use, whereby upon rotation of the shaft the bit face crushes an insulated wire as it exits from the wire-supplying hole and is wrapped around a terminal located in the terminal-receiving hole causing the insulation adjacent the terminal corners to be pierced baring the wire core and causing the bared wire core to form a good electrical connection to the terminal.

3. A wrapping bit as claimed in claim 2, and further comprising a fixed sleeve mounted on the bit end so as to surround the said bit face and projecting walls.

4. A wire wrapping tool comprising an elongated housing having at one end means providing a supply of insulated wire and having at the opposite end the wrapping bit configuraion as claimed in claim 2.

5. A wire wrapping tool as claimed in claim 4 wherein said housing has a passageway through its interior for movement of the wire from the wire supply means to the bit face, and further comprising wire-locking means on the housing for releasably jamming the wire against a housing wall.

6. A novel wrapping bit configuration for wire-wrapping a non-stripped and non-slitted plastic insulated wire around a rectangular or square terminal, comprising an elongated shaft having adjacent terminal-receiving and wire-supplying passageways terminating in adjacent holes at a bit face surface at a forward end of the shaft, and on the bit face surrounding the terminal-receiving hole forwardly-projecting wall portions forming a channel so oriented and having a channel width and depth so related to the dimensions of the insulated wire and terminal that, upon rotation of the shaft, an insulated wire forced into the channel as it is drawn from the wire-supplying hole and tightly wrapped around a terminal located in the terminal-receiving hole is crushed between the terminal corners and the channel walls causing the plastic insulation adjacent the terminal corners to be pierced baring the wire core and causing the bared wire core to form a good electrical connection to the terminal.

7. A wrapping bit as claimed in claim 6, wherein the said channel is formed by substantially parallel walls spaced apart by an amount approximately equal to the sum of the terminal corner-to-corner dimension, the wire core diameter, and the wire insulation wall thickness.

8. A wrapping bit as claimed in claim 6, wherein the said channel has a depth at least equal to twice the overall diameter of the insulated wire.

9. A wrapping bit as claimed in claim 6, wherein the said channel is tilted with respect to a line perpendicular to the terminal-receiving and wire-exiting holes at an angle of approximately 20°–35° in the direction opposite to bit rotation during use.

10. A wire-wrapping tool comprising an elongated housing having mounted at one end a removable spool of wire and having at the opposite end of the wrapping bit configuration as claimed in claim 6 and also having means for causing the wire to move from the spool through the housing and through the wire-supplying hole in the bit face.

11. A tool as claimed in claim 10 and furhter including means on the housing for releasably locking the wire to the housing.

* * * * *